US006218029B1

(12) United States Patent
Rickerby

(10) Patent No.: US 6,218,029 B1
(45) Date of Patent: Apr. 17, 2001

(54) THERMAL BARRIER COATING FOR A SUPERALLOY ARTICLE AND A METHOD OF APPLICATION THEREOF

(75) Inventor: David S Rickerby, Derby (GB)

(73) Assignees: Rolls-Royce, PLC, London (GB); Chromalloy United Kingdom Limited, Nottingham (GB)

( * ) Notice: Subject to any disclaimer, the term of this patent is extended or adjusted under 35 U.S.C. 154(b) by 0 days.

(21) Appl. No.: 08/971,726

(22) Filed: Nov. 17, 1997

(30) Foreign Application Priority Data

Nov. 30, 1996 (GB) ..... 9624986

(51) Int. Cl.[7] ..... B32B 15/00

(52) U.S. Cl. ..... 428/615; 428/632; 428/640; 428/652; 428/668; 428/670; 428/680; 416/241 R; 416/241 B

(58) Field of Search ..... 428/623, 253, 428/632, 614, 615, 639, 40, 652, 668, 670, 680; 416/241 B, 241 R

(56) References Cited

U.S. PATENT DOCUMENTS

| | | | |
|---|---|---|---|
| 4,248,940 | 2/1981 | Goward et al. . | |
| 4,321,311 | 3/1982 | Strangman . | |
| 4,916,022 | 4/1990 | Solfest et al. . | |
| 5,141,821 | 8/1992 | Lugscheider et al. . | |
| 5,716,720 * | 2/1998 | Murphy | 428/623 |
| 5,763,107 * | 6/1998 | Rickerby et al. | 428/623 |

FOREIGN PATENT DOCUMENTS

| | | |
|---|---|---|
| 0482831 | 4/1992 | (EP) . |
| 0652299 | 5/1995 | (EP) . |
| 0688886 | 12/1995 | (EP) . |
| 0718419 | 6/1996 | (EP) . |
| 0718420 | 6/1996 | (EP) . |
| 2006274 | 5/1979 | (GB) . |
| 2214523 | 9/1989 | (GB) . |

* cited by examiner

*Primary Examiner*—Timothy M. Speer
*Assistant Examiner*—Bryant Young
(74) *Attorney, Agent, or Firm*—Oliff & Berridge, PLC

(57) ABSTRACT

A multi-layer thermal barrier coating for a superalloy article includes a metallic matrix coating containing particles, a MCrAlY alloy bond coating on the metallic matrix coating, a thin oxide layer on the MCrAlY alloy bond coating and a columnar grain ceramic thermal barrier coating. The metallic matrix coating includes a 80 wt % nickel-20 wt % chromium alloy. The particles include metallic compounds such as carbides, oxides, borides and nitrides, which react with harmful transition metal elements such as titanium, tantalum and hafnium, in the superalloy substrate. One suitable compound is chromium carbide because the harmful transition metal elements will take part in an exchange reaction with the chromium in the chromium carbide to form a stable carbide of the harmful transition metal element. This reduces the amount of harmful elements in the superalloy reaching the oxide layer and increases the service life of the thermal barrier coating.

16 Claims, 3 Drawing Sheets

THERMAL BARRIER COATING FOR A SUPERALLOY ARTICLE AND A METHOD OF APPLICATION THEREOF

BACKGROUND OF THE INVENTION

The present invention relates to a thermal barrier coating applied to the surface of a superalloy article e.g. a gas turbine engine turbine blade, and to a method of applying the thermal barrier coating.

The constant demand for increased operating temperature in gas turbine engines was initially met by air cooling of the turbine blades and the development of superalloys from which to manufacture the turbine blades and turbine vanes, both of which extended their service lives. Further temperature increases necessitated the development of ceramic coating materials with which to insulate the turbine blades and turbine vanes from the heat contained in the gases discharged from the combustion chambers, again the operating lives of the turbine blades and turbine vanes was extended. However, the amount of life extension was limited because the ceramic coatings suffered from inadequate adhesion to the superalloy substrate. One reason for this is the disparity of coefficients of thermal expansion between the superalloy substrate and the ceramic coating. Coating adhesion was improved by the development of various types of aluminum containing alloy bond coatings which were thermally sprayed or otherwise applied to the superalloy substrate before the application of the ceramic coating. Such bond coatings are typically of the so-called aluminide (diffusion) or "MCrAlY" types, where M signifies one or more of cobalt, iron and nickel.

Use of bond coatings has been successful in preventing extensive spallation of thermal barrier coatings during service, but localized spallation of the ceramic coating still occurs where the adhesion fails between the bond coating and the ceramic coating. This exposes the bond coating to the full heat of the combustion gases, leading to premature failure of the turbine blade or turbine vane.

SUMMARY OF THE INVENTION

The present invention seeks to provide a novel bond coating for a thermal barrier coating which is less prone to localized failure and more suitable for long term adhesion to a superalloy substrate.

The present invention seeks to provide a method of applying a thermal barrier coating to a superalloy substrate so as to achieve improved adhesion thereto.

Accordingly the present invention provides a multi-layer thermal barrier coating for a superalloy substrate, comprising a bond coating, an oxide layer on the bond coating and a ceramic thermal barrier coating on the oxide layer, the bond coating containing aluminium at least in the outer region of the bond coating, the bond coating containing at least one metal compound at least in the inner region of the bond coating, the at least one metal compound is selected such that at least one harmful element diffusing from the superalloy substrate into the aluminum containing alloy bond coating substrate reacts with the metal compound to release the metal into the bond coating and to form a compound with the harmful element.

It is believed that the metal compound in the bond coating reduces the movement of damaging elements from the superalloy substrate to the oxide layer. It is believed that the damaging elements diffusing from the superalloy substrate react with the metal compound such that an exchange reaction occurs and the damaging elements form benign compounds and the metal is released into the bond coating.

The at least one metal compound may be a carbide, an oxide, a nitride or a boride.

For example the at least one metal compound may be one or more of chromium carbide, manganese carbide, molybdenum carbide, aluminum carbide, nickel carbide or tungsten carbide.

The at least one metal compound may be in the form of particles distributed evenly at least throughout the inner region of the bond coating.

The bond coating may comprise an aluminum containing alloy bond coating with the at least one metal compound distributed evenly throughout the whole of the aluminum containing alloy bond coating. The aluminum containing alloy bond coating may comprise a MCrAlY alloy, where M is at least one of Ni, Co and Fe.

The bond coating may comprise a first coating and a second aluminum containing alloy coating on the first coating, the first coating comprising a nickel aluminum alloy, a nickel cobalt alloy, a nickel chromium alloy, a cobalt aluminum alloy or a cobalt chromium alloy with the at least one metal compound distributed evenly throughout the whole of the first coating.

The bond coating may comprise a first coating and a second aluminum containing alloy coating on the first coating, a platinum-group metal enriched aluminum containing alloy layer on the aluminum containing alloy coating, a coating of at least one aluminide of the platinum-group metals on the platinum-group metal enriched aluminum containing alloy layer, the first coating comprising a nickel aluminum alloy, a nickel cobalt alloy, a nickel chromium alloy, a cobalt aluminum alloy or a cobalt chromium alloy with the at least one metal compound distributed evenly throughout the whole of the first coating.

The bond coating may comprise an aluminum containing alloy bond coating, a platinum-group metal enriched aluminum containing alloy layer on the aluminum containing alloy coating, a coating of at least one aluminide of the platinum-group metals on the platinum-group metal enriched aluminum containing alloy layer, the at least one metal compound being distributed evenly throughout the whole of the aluminum containing alloy bond coating. The aluminum containing alloy bond coating may comprise a MCrAlY alloy, where M is at least one of Ni, Co and Fe.

The present invention also provides a method of applying a multi-layer thermal barrier coating to a superalloy substrate comprising the steps of:- applying an aluminum containing alloy bond coating to the superalloy substrate, the aluminum containing alloy bond coating including at least one metal compound distributed evenly throughout the whole of the aluminum containing alloy bond coating, the at least one metal compound is selected such that at least one harmful element diffusing from the superalloy substrate into the aluminum containing alloy bond coating reacts with the metal compound to release the metal into the bond coating and to form a compound with the harmful element, forming an oxide layer on the aluminum containing alloy bond coating and applying a ceramic thermal barrier coating on the oxides layer.

The present invention also provides a method of applying a multi-layer thermal barrier coating to a superalloy substrate comprising the steps of:- applying a first coating to the superalloy substrate, the first coating including at least one metal compound distributed evenly throughout the whole of the first coating, the at least one metal compound is selected such that at least one harmful element diffusing from the superalloy substrate into the first coating reacts with the metal compound to release the metal into the first coating and to form a compound with the harmful element, applying a second aluminum containing alloy coating on the first coating, forming an oxide layer on the aluminum containing alloy bond coating and applying a ceramic thermal barrier coating on the oxide layer.

The present invention also provides a method of applying a multi-layer thermal barrier coating to a superalloy substrate comprising the steps of: applying a a first coating to the superalloy substrate, the first coating including at least one metal compound distributed evenly throughout the whole of the first coating, the at least one metal compound is selected such that at least one harmful element diffusing from the superalloy substrate into the first coating reacts with the metal compound to release the metal into the first coating and to form a compound with the harmful element, applying a second aluminum containing alloy coating on the first coating, applying a layer of platinum-group metal to the aluminum containing alloy coating, heat treating the superalloy substrate to diffuse the platinum-group metal into the aluminum containing alloy coating to create a platinum-group metal enriched aluminum containing layer and a coating of at least one aluminide of the platinum-group metals on the platinum-group metal enriched aluminum containing alloy layer, forming an oxide layer on the coating of at least one aluminide of the platinum-group metals and applying a ceramic thermal barrier coating to the oxide layer.

The present invention also provides a method of applying a multi-layer thermal barrier coating to a superalloy substrate comprising the steps of:- applying an aluminum containing alloy bond coating to the superalloy substrate, the aluminum containing alloy coating including at least one metal compound distributed evenly throughout the whole of the aluminum containing alloy coating, the at least one metal compound is selected such that at least one harmful element diffusing from the superalloy substrate into the aluminum containing alloy coating reacts with the metal compound to release the metal into the aluminum containing alloy coating and to form a compound with the harmful element, applying a layer of platinum-group metal to the aluminum containing alloy coating, heat treating the superalloy substrate to diffuse the platinum-group metal into the aluminum containing alloy coating to create a platinum-group metal enriched aluminum containing alloy layer on the aluminum containing alloy coating and a coating of at least one aluminide of the platinum-group metals on the platinum-group metal enriched aluminum containing alloy layer, forming an oxide layer on the coating of at least one aluminide of the platinum-group metals and applying a ceramic thermal barrier coating to the oxide layer.

The at least one metal compound may be a carbide, an oxide, a nitride or a boride.

For example, the at least one metal compound may be one or more of chromium carbide, manganese carbide, molybdenum carbide, aluminum carbide, nickel carbide or tungsten carbide.

The at least one metal compound may be in the form of particles distributed evenly throughout the first coating of the bond coating or throughout the aluminum containing alloy coating. The aluminum containing alloy bond coating may comprise a MCrAlY alloy, where M is at least one of Ni, Co and Fe.

The first coating may comprise a nickel aluminum alloy, a nickel cobalt alloy, a nickel chromium alloy, a cobalt aluminum alloy or a cobalt chromium alloy with the at least one metal compound distributed evenly throughout the whole of the first coating.

BRIEF DESCRIPTION OF THE DRAWINGS

The present invention will be more fully described by way of example with reference to the accompanying drawings, in which.

DETAILED DESCRIPTION OF THE PREFERRED EMBODIMENTS

Figure 1:
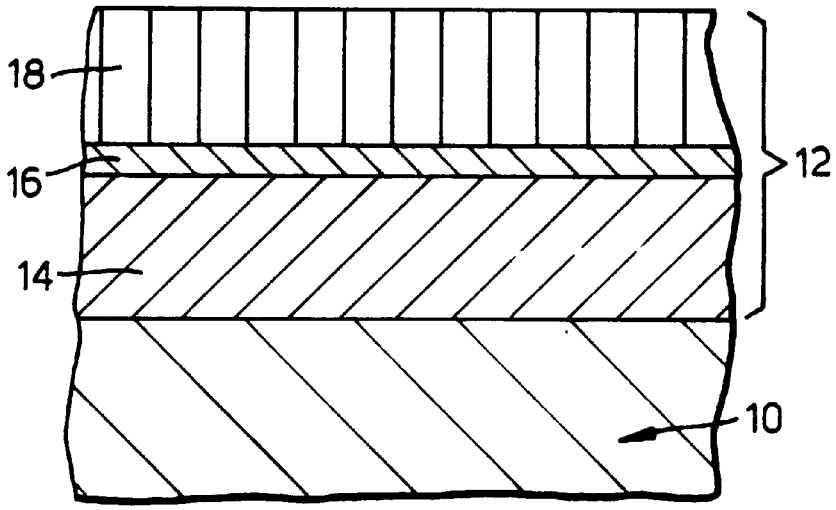
FIG. 1 is a cross-sectional diagrammatic view through a metallic article having a prior art thermal barrier coating applied thereto.

Referring to FIG. 1, illustrating the state of the art, there is shown part of a superalloy article 10 provided with a multi-layer thermal barrier coating indicated generally by numeral 12. It is shown in the as manufactured condition. The thermal barrier coating 12 comprises a MCrAlY alloy bond coating 14, a thin oxide layer 16 and a columnar grain ceramic thermal barrier coating 18. The MCrAlY alloy bond coating 14 is applied by plasma spraying and is diffusion heat treated. The columnar grain ceramic thermal barrier coating 18 comprises yttria stabilised zirconia or other suitable ceramic applied by electron beam physical vapour deposition. The thin oxide layer 16 comprises a mixture of alumina, chromia and other spinels.

Figure 2:
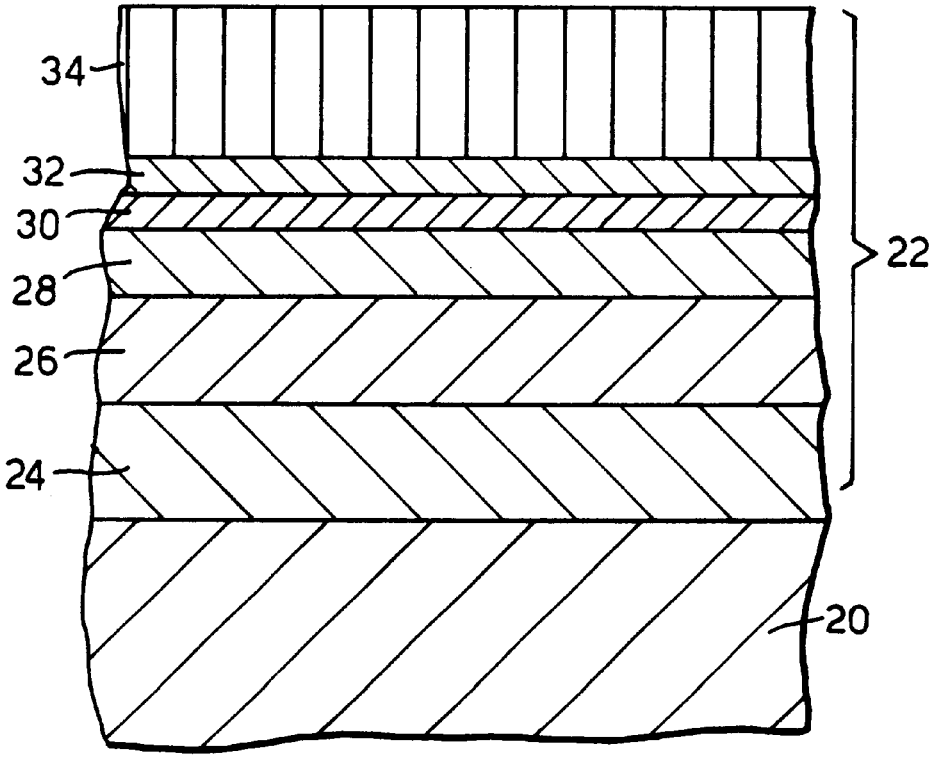
FIG. 2 is a cross-sectional diagrammatic view through a metallic article having a prior art thermal barrier coating applied thereto.

Referring to FIG. 2, illustrating the state of the art as described in our co-pending European patent application 95308925.7 filed Dec. 8, 1995, there is shown part of a superalloy article 20 provided with a multi-layer thermal barrier coating indicated generally by numeral 22. It is shown in the as manufactured condition. The thermal barrier coating 22 comprises a MCrAlY alloy bond coating 24, a platinum enriched MCrAlY alloy layer 26 on the MCrAlY alloy bond coating 24, a platinum aluminide coating 28 on the platinum enriched MCrAlY alloy layer 26, a platinum enriched gamma phase layer 30 on the platinum aluminide coating 28, a thin oxide layer 32 on the platinum enriched gamma phase layer 30 and a columnar grain ceramic thermal barrier coating 34.

The MCrAlY bond coating 24 is applied by plasma spraying and is diffusion heat treated. The columnar grain ceramic thermal barrier coating 34 comprises yttria stabilised zirconia or other suitable ceramic applied by electron beam physical vapor deposition. The thin oxide layer 32 comprises wholly or almost wholly alumina, with much smaller or negligible amounts of the other spinels. The thickness of the alumina layer 32 is less than one micron.

The platinum is applied to a substantially uniform thickness onto the MCrAlY bond coating by electroplating or other suitable method, the thickness being at least 5 microns, and preferably about 8 microns. Thereafter a diffusion heat treatment step is effected so as to cause the platinum layer to diffuse into the MCrAlY alloy bond coating. This provides the platinum enriched MCrAlY alloy layer and the platinum aluminide coating. Diffusion is achieved by heating the article to a temperature in the range of 1000° C. to 1200° C. and holding at that temperature for a suitable period of time, in particular a temperature of 1150° C. for a period of one hour is a suitable diffusion heat treatment cycle.

After heat treatment the surface is grit blasted with dry alumina powder to remove any diffusion residues. The ceramic thermal barrier coating is then applied by EBPVD, to produce a thin thin oxide layer on the platinum aluminide coating with a platinum enriched gamma phase layer therebetween.

The thermal barrier coating 12 described with reference to FIG. 1 and the thermal barrier coating 22 described with reference to FIG. 2 have been tested. It has been found that the thermal barrier coating 12 has a critical load, beyond which the ceramic would break away from the bond coating, of about 55 Newtons in the as manufactured condition and about 5 Newtons after ageing at 1150° C. for 100 hours. It has also been found that the thermal barrier coating 22 has a critical load, beyond which the ceramic would break away from the bond coating, of about 100 Newtons in the as manufactured condition and about 50 Newtons after ageing at 1150° C. for 100 hours, see our co-pending European patent application no. 95308925.7 filed Dec. 8, 1995.

It can be seen that the thermal barrier coating 22 shown in FIG. 2 gives a significant improvement in long term adhesion relative to the thermal barrier coating shown in FIG. 1.

The thermal barrier coating 22 shown in FIG. 2 has a continuous platinum aluminide coating 28 which is is believed blocks the movement of transition metal elements, for example titanium, tantalum and hafnium, from the MCrAlY bond coating 24 and the superalloy substrate 20 to the oxide layer 32 and ensures that the oxide layer formed is very pure alumina.

Figure 3:
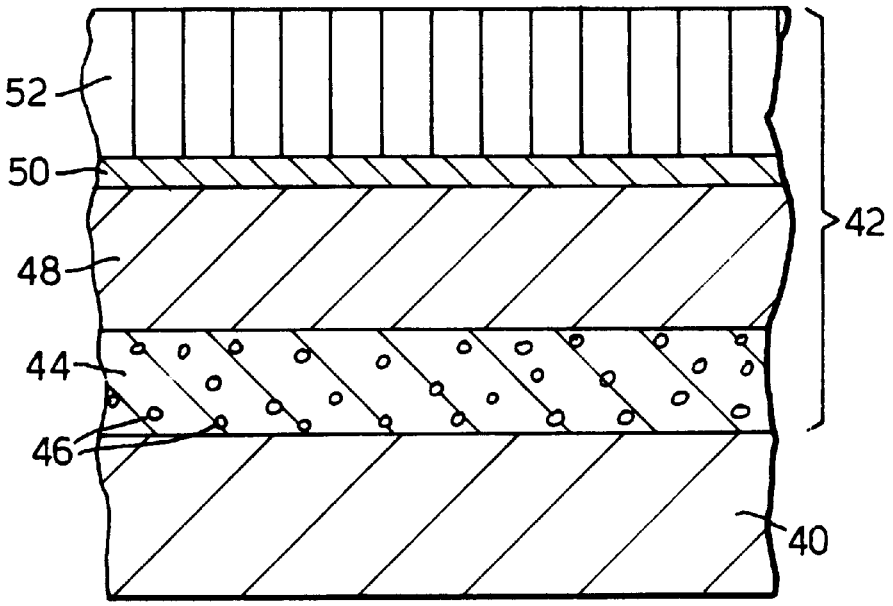
FIG. 3 is a cross-sectional diagrammatic view through a metallic article having a thermal barrier coating according to the present invention.

Referring to FIG. 3, illustrating the present invention there is shown part of a superalloy article 40 provided with a multi-layer thermal barrier coating indicated generally by numeral 42. It is shown in the as manufactured condition. The thermal barrier coating 42 comprises a metallic matrix coating 44 containing particles 46, a MCrAlY alloy bond coating 48 on metallic matrix coating 44, a thin oxide layer 50 and a columnar grain ceramic thermal barrier coating 52. The MCrAlY alloy bond coating 48 is applied by plasma spraying and is diffusion heat treated. The metallic matrix coating 44 and particles 46 are applied by vacuum or air plasma spraying. The metallic matrix coating 44 comprises a nickel aluminum alloy, a nickel cobalt alloy, a nickel chromium alloy, a cobalt aluminum alloy or a cobalt chromium alloy. The particles 46 comprise suitable metallic compounds which are selected such that they will react with harmful transition metal elements, for example titanium, tantalum and hafnium, in the superalloy substrate. Suitable compounds are those where the harmful transition metal element will take part in an exchange reaction with the metal in the metal compound to form a stable compound of the harmful transition metal element and release the metal into the metallic matrix coating 44. These compounds are generally carbides, oxides, nitrides and borides of metallic elements. In particular the following carbides are suitable because titanium and tantalum are stronger carbide formers, chromium carbide, manganese carbide, molybdenum carbide, aluminum carbide, nickel carbide and tungsten carbide. The columnar grain ceramic thermal barrier coating 52 comprises yttria stabilised zirconia or other suitable ceramic applied by electron beam physical vapour deposition. The thin oxide layer 50 comprises a mixture of alumina, chromia and other spinels.

For example a metallic matrix alloy 44 comprising 80 wt % Ni and 20 wt % Cr and containing CrC particles 46 was air or vacuum plasma sprayed to a thickness of 0.025 mm on a nickel superalloy 40. A MCrAlY alloy bond coating 48 was vacuum plasma sprayed onto the metallic matrix alloy 44 to a thickness of 0.125 mm and an yttria stabilised zirconia ceramic thermal barrier coating 52 was electron beam physical vapour deposited onto the MCrAlY alloy bond coating 48 to a thickness of 0.25 mm and to form the thin oxide layer 50. It has been found that the thermal barrier coating 42, as shown in FIG. 3, has a critical load, beyond which the ceramic would break away from the bond coating, of about 35 Newtons in the as manufactured condition and about 10 Newtons after ageing at 1150° C. for 25 hours. In comparison a thermal barrier coating 12, as shown in FIG. 1, has a critical load of about 45 Newtons in the as manufactured condition and about 0 Newtons after ageing at 1150° C. for 25 hours. Thus it can be seen that the thermal barrier coating with the nickel chromium coating 44 containing the chromium carbide particles 46 has a greater critical load, after ageing, than the thermal barrier coating without the nickel chromium coating 44 containing the chromium carbide particles 46.

It is believed that any harmful transition metal elements, e.g. titanium, tantalum and hafnium, diffusing from the superalloy substrate 40 into the thermal barrier coating 42 react with the chromium carbide particles 46 to form titanium carbide, tantalum carbide or hafnium carbide and release chromium into the metal matrix alloy coating 44. It is believed that in forming stable carbides of titanium, tantalum and hafnium, the amount of unreacted harmful transition metal elements diffusing to the oxide layer 50 is reduced, thus increasing the service life of the thermal barrier coating 42. It is known that titanium, tantalum and hafnium degrade the ceramic thermal barrier coating 52 bonding to the oxide layer 50 by weakening the bonding of aluminium oxide.

Figure 4:
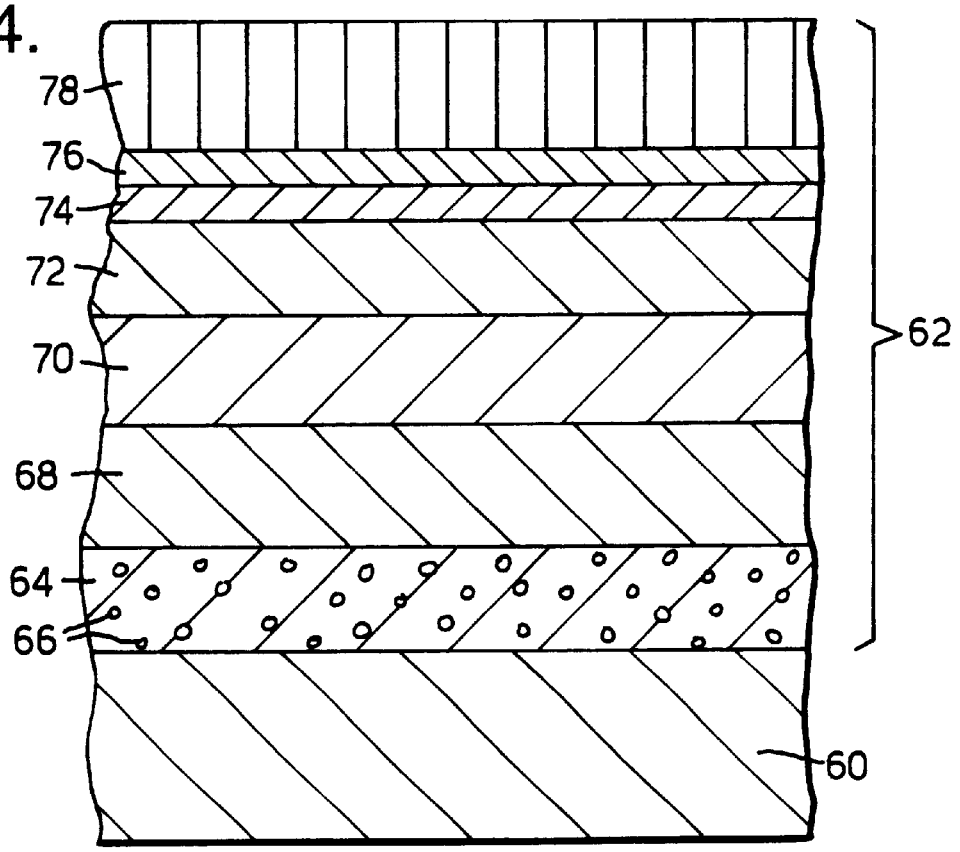
FIG. 4 is a cross-sectional diagrammatic view through a metallic article having a thermal barrier coating according to the present invention.

Referring to FIG. 4, illustrating the present invention there is shown part of a superalloy article 60 provided with a multi-layer thermal barrier coating indicated generally by numeral 62. It is shown in the as manufactured condition. The thermal barrier coating 62 comprises a metallic matrix coating 64 containing particles 66, a MCrAlY alloy bond coating 68 on metallic matrix coating 64, a platinum enriched MCrAlY alloy layer 70, a platinum aluminide coating 72, a platinum enriched gamma phase layer 74, a thin oxide layer 76 and a columnar grain ceramic thermal barrier coating 78. The platinum aluminide coating 72 is a special form of platinum aluminide and has a composition for example of 53 wt % Pt, 19.5 wt % Ni, 12 wt % Al, 8.7 wt % Co, 4.9 wt % Cr, 0.9 wt % Zr, 0.6 wt % Ta, 0.1 wt % O and 0.04 wt % Ti as is described more fully in our co-pending European patent application no. 95308925.7.

The metallic matrix coating 64 and particles 66 are applied by vacuum or air plasma spraying. The metallic matrix coating 64 comprises a nickel aluminum alloy, a nickel cobalt alloy, a nickel chromium alloy, a cobalt aluminum alloy or a cobalt chromium alloy. The particles 66 comprises suitable metallic compounds which are selected such that they will react with harmful transition metal elements, for example titanium, tantalum and hafnium, in the superalloy substrate. Suitable compounds are those where the harmful transition metal element will take part in an exchange reaction with the metal in the metal compound to form a stable compound of the harmful transition metal element and release the metal into the metallic matrix coating 64. These compounds are generally carbides, oxides, nitrides and borides of metallic elements. In particular the following carbides are suitable because titanium and tantalum are stronger carbide formers, chromium carbide, manganese carbide, molybdenum carbide, aluminum carbide, nickel carbide and tungsten carbide.

It is believed that any harmful transition metal elements, e.g. titanium, tantalum and hafnium, diffusing from the superalloy substrate 60 into the thermal barrier coating 62 react with the chromium carbide particles 66 to form titanium carbide, tantalum carbide or hafnium carbide and release chromium into the metal matrix alloy coating 64. It is believed that in forming stable carbides of titanium, tantalum and hafnium, the amount of unreacted harmful transition metal elements diffusing to the oxide layer 76 is reduced, thus increasing the service life of the thermal barrier coating 62. It is known that titanium, tantalum and hafnium degrade the ceramic thermal barrier coating 78 bonding to the oxide layer 76 by weakening the bonding of aluminium oxide.

The MCrAlY alloy bond coating 68 is preferably applied by vacuum plasma spraying although other suitable methods such as physical vapour deposition may be used. If vacuum plasma spraying is used the MCrAlY may be polished to improve the adhesion of the ceramic thermal barrier coating. The platinum is applied to a substantially uniform thickness onto the MCrAlY alloy bond coating 68 by electroplating or other suitable method, the thickness being at least 5 microns, and preferably about 8 microns. Thereafter a diffusion heat treatment step is effected so as to cause the platinum layer to diffuse into the MCrAlY alloy coating. This provides the platinum enriched MCrAlY alloy layer and the platinum aluminide coating. Diffusion is achieved by heating the article to a temperature in the range of 1000° C. to 1200° C. and holding at that temperature for a suitable period of time, preferably by heating the article to a temperature in the range 1100° C. to 1200° C., in particular a temperature of 1150° C. for a period of one hour is a suitable diffusion heat treatment cycle.

The platinum may also be applied by sputtering, chemical vapor deposition or physical vapor deposition. Other platinum-group metals, for example palladium, rhodium etc. may be used instead of platinum, but platinum is preferred.

After heat treatment the surface is grit blasted with dry alumina powder to remove any diffusion residues. The columnar grain ceramic thermal barrier coating 78 comprises yttria stabilized zirconia or other suitable ceramic and is applied by electron beam physical vapour deposition to produce the thin oxide layer 76 on the platinum aluminide coating with the platinum enriched gamma phase layer therebetween. The oxide layer comprises a very pure alumina.

Figure 5:
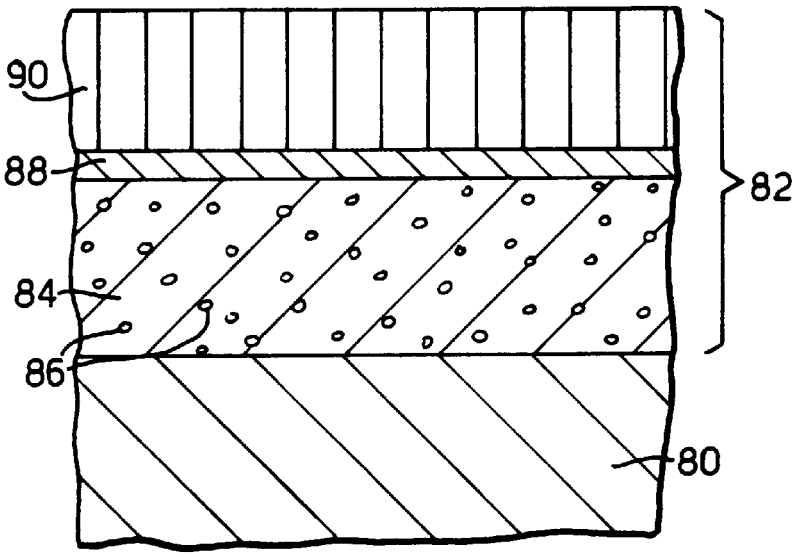
FIG. 5 is a cross-sectional diagrammatic view through a metallic article having a thermal barrier coating according to the present invention.

Referring to FIG. 5, illustrating the present invention there is shown part of a superalloy article 80 provided with a multi-layer thermal barrier coating indicated generally by numeral 82. It is shown in the as manufactured condition. The thermal barrier coating 82 comprises a MCrAlY alloy bond coating 84 containing particles 86, a thin oxide layer 88 on the MCrAlY alloy bond coating 84 and a columnar grain ceramic thermal barrier coating 90. The MCrAlY alloy bond coating 84 and particles 86 are applied by vacuum or air plasma spraying and is diffusion heat treated. The particles 86 comprises suitable metallic compounds which are selected such that they will react with harmful transition metal elements, for example titanium, tantalum and hafnium, in the superalloy substrate. Suitable compounds are those where the harmful transition metal element will take part in an exchange reaction with the metal in the metal compound to form a stable compound of the harmful transition metal element and release the metal into the MCrAlY alloy bond coating 84. These compounds are generally carbides, oxides, nitrides and borides of metallic elements. In particular the following carbides are suitable because titanium and tantalum are stronger carbide formers, chromium carbide, manganese carbide, molybdenum carbide, aluminum carbide, nickel carbide and tungsten carbide. The columnar grain ceramic thermal barrier coating 90 comprises yttria stabilized zirconia or other suitable ceramic applied by electron beam physical vapor deposition. The thin oxide layer 88 comprises a mixture of alumina, chromia and other spinels.

It is believed that any harmful transition metal elements, e.g. titanium, tantalum and hafnium, diffusing from the superalloy substrate 80 into the thermal barrier coating 82 react with the chromium carbide particles 86 to form titanium carbide, tantalum carbide or hafnium carbide and release chromium into the MCrAlY alloy bond coating 84. It is believed that in forming stable carbides of titanium, tantalum and hafnium, the amount of unreacted harmful transition metal elements diffusing to the oxide layer 88 is reduced, thus increasing the service life of the thermal barrier coating 82. It is known that titanium, tantalum and hafnium degrade the ceramic thermal barrier coating 90 bonding to the oxide layer 88 by weakening the bonding of aluminium oxide.

Figure 6:
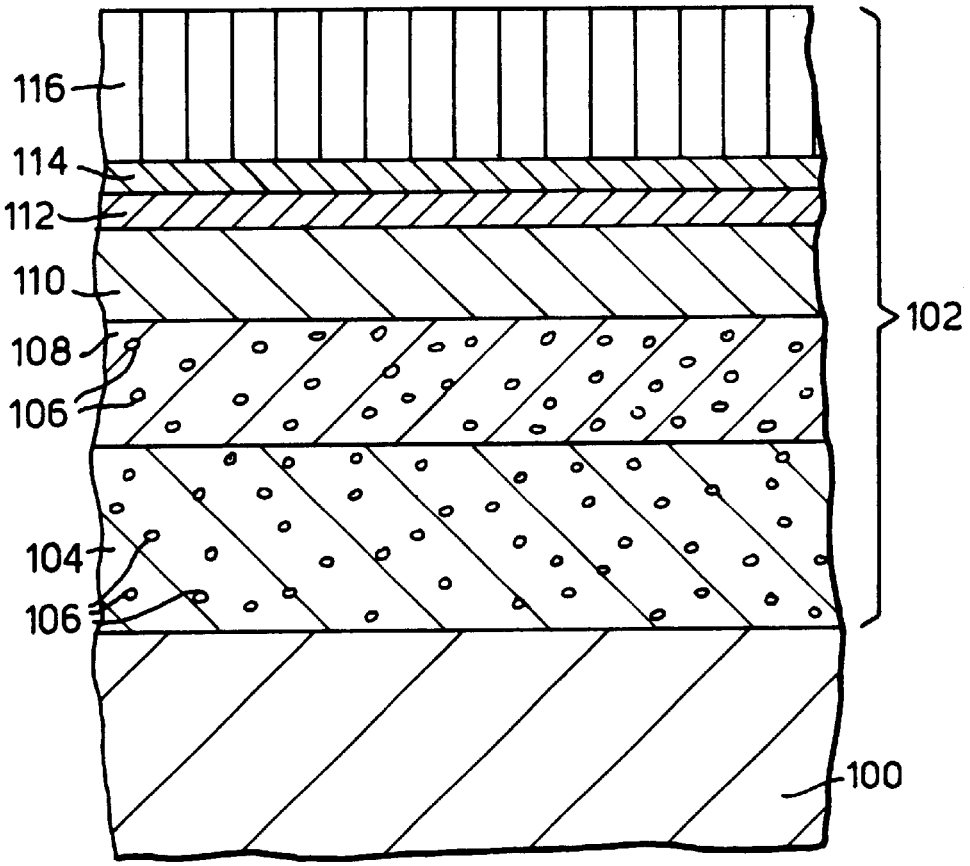
FIG. 6 is a cross-sectional diagrammatic view through a metallic article having a thermal barrier coating according to the present invention.

Referring to FIG. 6, illustrating the present invention there is shown part of a superalloy article 100 provided with a multi-layer thermal barrier coating indicated generally by numeral 102. It is shown in the as manufactured condition. The thermal barrier coating 102 comprises a MCrAlY alloy bond coating 104 containing particles 106, a platinum enriched MCrAlY alloy layer 108, a platinum aluminide coating 110, a platinum enriched gamma phase layer 112, a thin oxide layer 114 and a columnar grain ceramic thermal barrier coating 116. The platinum aluminide coating 110 is a special form of platinum aluminide and has a composition for example of 53 wt % Pt, 19.5 wt % Ni, 12 wt % Al, 8.7 wt % Co, 4.9 wt % Cr, 0.9 wt % Zr, 0.6 wt % Ta, 0.1 wt % O and 0.04 wt % Ti as is described more fully in our co-pending European patent application no. 95308925.7.

The MCrAlY alloy bond coating 104 and particles 106 are applied by vacuum or air plasma spraying. The particles 106 comprises suitable metallic compounds which are selected such that they will react with harmful transition metal elements, for example titanium, tantalum and hafnium, in the superalloy substrate. Suitable compounds are those where the harmful transition metal element will take part in an exchange reaction with the metal in the metal compound to form a stable compound of the harmful transition metal element and release the metal into the MCrAlY alloy bond coating 104. These compounds are generally carbides, oxides, nitrides and borides of metallic elements. In particular the following carbides are suitable because titanium and tantalum are stronger carbide formers, chromium carbide, manganese carbide, molybdenum carbide, aluminum carbide, nickel carbide and tungsten carbide.

It is believed that any harmful transition metal elements, e.g. titanium, tantalum and hafnium, diffusing from the superalloy substrate 100 into the thermal barrier coating 102 react with the chromium carbide particles 106 to form titanium carbide, tantalum carbide or hafnium carbide and release chromium into the MCrAlY alloy bond coating 104. It is believed that in forming stable carbides of titanium, tantalum and hafnium, the amount of unreacted harmful transition metal elements diffusing to the oxide layer 114 is reduced, thus increasing the service life of the thermal barrier coating 102. It is known that titanium, tantalum and hafnium degrade the ceramic thermal barrier coating 116 bonding to the oxide layer 114 by weakening the bonding of aluminium oxide.

It may be possible to deposit the ceramic thermal barrier coating by plasma spraying, vacuum plasma spraying, air plasma spraying, chemical vapor deposition, combustion chemical vapor deposition or preferably physical vapor deposition. The physical vapour deposition processes include sputtering, but electron beam physical vapor deposition is preferred.

Other aluminum containing alloy bond coats other than MCrAlY may be used for example cobalt aluminide or nickel aluminide.

The thermal barrier coating may be applied to the whole of the surface of an article, or to predetermined areas of the surface of an article, to provide thermal protection to the article. For example, the whole of the surface of the aerofoil of a gas turbine blade may be coated with a thermal barrier coating, or alternatively only the leading edge of the aerofoil of a gas turbine blade may be coated.

I claim:

1. A multi-layer thermal barrier coating for a superalloy substrate, comprising a bond coating on the superalloy substrate, an oxide layer on the bond coating and a ceramic thermal barrier coating on the oxide layer, the bond coating comprising an inner region adjacent the superalloy substrate and an outer region adjacent the oxide layer, the bond coating comprising aluminum at least in the outer region of the bond coating, the bond coating comprising at least one metal compound at least in the inner region of the bond coating, the at least one metal compound is selected such that at least one harmful element diffusing from the superalloy substrate into the aluminum containing alloy bond coating reacts with the metal compound to release the metal into the bond coating and to form a compound with the harmful element.

2. A thermal barrier coating as claimed in claim 1 wherein the at least one metal compound is in the form of particles distributed evenly at least throughout the inner region of the bond coating.

3. A thermal barrier coating as claimed in claim 1 wherein the bond coating comprises an aluminum containing alloy bond coating with the at least one metal compound distributed evenly throughout the whole of the aluminum containing alloy bond coating.

4. A thermal barrier coating as claimed in claim 3 wherein the aluminum containing alloy bond coating comprises a MCrAlY alloy, where M is at least one of Ni, Co and Fe.

5. A thermal barrier coating as claimed in claim 1 wherein the inner region of the bond coating comprises a first coating and the outer region of the bond coating comprises a second aluminum containing alloy coating on the first coating, the first coating is selected from the group consisting of a nickel aluminum alloy, a nickel cobalt alloy, a cobalt chromium alloy and an MCrAlY alloy, where M is at least one of cobalt, nickel and iron, with the at least one metal compound distributed evenly throughout the whole of the first coating.

6. A thermal barrier coating as claimed in claim 1 wherein the inner region of the bond coating comprises a first coating and the outer region of the bond coating comprises a second aluminum containing alloy coating on the first coating, a platinum-group metal enriched aluminum containing alloy layer on the aluminum containing alloy coating, a coating of at least one aluminide of the platinum-group metals on the platinum-group metal enriched aluminum containing alloy coating, the first coating is selected from the group consisting of a nickel aluminum alloy, a nickel cobalt alloy, a nickel chromium alloy, a cobalt aluminum alloy, a cobalt chromium alloy and a MCrAlY alloy, where M is at least one of cobalt, nickel and iron, with the at least one metal compound distributed evenly throughout the whole of the first coating.

7. A thermal barrier coating as claimed in claim 1 wherein the bond coating comprises an aluminum containing alloy bond coating, a platinum-group metal enriched aluminum containing alloy layer on the aluminum containing alloy coating, a coating of at least one aluminide of the platinum-group metals on the platinum-group metal enriched aluminum containing alloy layer, the at least one metal compound being distributed evenly throughout the whole of the aluminum containing alloy bond coating.

8. A thermal barrier coating as claimed in claim 7 wherein the aluminum containing alloy bond coating comprises a MCrAlY alloy, where M is at least one of Ni, Co and Fe.

9. A multilayer thermal barrier coating for a superalloy substrate, comprising a bond coating on the superalloy substrate, an oxide layer on the bond coating and a ceramic thermal barrier coating on the oxide layer, the bond coating comprising a first coating on the superalloy substrate and a second aluminum containing alloy coating on the first coating, the first coating including at least one metal compound distributed evenly throughout the whole of the first coating, the at least one metal compound being selected such that at least one harmful element diffusing from the superalloy substrate into the first coating reacts with the metal compound to release the metal into the first coating and to form a compound with the harmful element.

10. A multi-layer thermal barrier coating for a superalloy substrate, comprising a bond coating on the superalloy substrate, an oxide layer on the bond coating and a ceramic thermal barrier coating on the oxide layer, the bond coating comprising a first coating on the superalloy substrate and a second aluminum containing alloy coating on the first coating, a platinum-group metal enriched aluminum containing alloy layer on the aluminum containing alloy coating, a coating of at least one aluminide of the platinum-group metals on the platinum-group metal enriched aluminum containing alloy layer, the first coating including at least one metal compound distributed evenly throughout the whole of the first coating, the at least one metal compound being selected such that at least one metal compound being selected such that at least one harmful element diffusing from the superalloy substrate into the first coating reacts with the metal compound to release the metal into the first coating and to form a compound with the harmful element.

11. A thermal barrier coating as claimed in claim 9 wherein the at least one metal compound is selected from the group consisting of a carbide, an oxide, a nitride and a boride.

12. A thermal barrier coating as claimed in claim 10 wherein the first coating is selected from the group consisting of a nickel aluminum alloy, a nickel cobalt alloy, a nickel chromium alloy, a cobalt aluminum alloy, a cobalt chromium alloy and a MCrAlY alloy, where M is at least one of cobalt, nickel and iron, with the at least one metal compound distributed evenly throughout the whole of the first coating.

13. A thermal barrier coating as claimed in claim 10 wherein the second aluminum containing alloy coating comprises a MCrAlY alloy, where M is at least one of cobalt, nickel and iron.

14. A multi-layer thermal barrier coating for a superalloy substrate, comprising a bond coating on the superalloy substrate, an oxide layer on the bond coating and a ceramic thermal barrier coating on the oxide layer, the bond coating comprising an inner region adjacent the superalloy substrate and an outer region adjacent the oxide layer, the bond coating comprising aluminum at least in the outer region of the bond coating, the bond coating comprising at least one metal compound at least in the inner region of the bond coating, the at least one metal compound being selected from the group consisting of a carbide, an oxide, a nitride and a boride, and the metal compound reacts with at least one harmful element diffusing from the superalloy substrate into the aluminum containing alloy bond coating to release the metal into the bond coating and to form a compound with the harmful element.

15. A multi-layer thermal barrier coating for a superalloy substrate, comprising a bond coating on the superalloy substrate, an oxide layer on the bond coating and a ceramic thermal barrier coating on the oxide layer, the bond coating comprising an inner region adjacent the superalloy substrate and an outer region adjacent the oxide layer, the bond coating comprising aluminum at least in the outer region of the bond coating, the bond coating comprising at least one metal compound at least in the inner region of the bond coating, the at least one metal compound being selected from the group consisting of chromium carbide, manganese carbide, molybdenum carbide, aluminum carbide, nickel carbide and tungsten carbide, and the at least one metal compound is selected such that at least one harmful element diffusing from the superalloy substrate into the aluminum containing alloy bond coating reacts with the metal compound to release the metal into the bond coating and to form a compound with the harmful element.

16. A multi-layer thermal barrier coating for a superalloy substrate, comprising a bond coating on the superalloy substrate, an oxide layer on the bond coating and a ceramic thermal barrier coating on the oxide layer, the bond coating comprising a first coating on the superalloy substrate and a second aluminum containing alloy coating on the first coating, a platinum-group metal enriched aluminum containing alloy layer on the aluminum containing alloy coating, a coating of at least one aluminide of the platinum-group metals on the platinum-group metal enriched aluminum containing alloy layer, the first coating including at least one metal compound distributed evenly throughout the whole of the first coating, the at least one metal compound being selected from the group consisting of chromium carbide, manganese carbide, molybdenum carbide, aluminum carbide, nickel carbide and tungsten carbide, and the at least one metal compound being selected such that at least one metal compound being selected such that at least one harmful element diffusing from the superalloy substrate into the first coating reacts with the metal compound to release the metal into the first coating and to form a compound with the harmful element.

* * * * *